United States Patent [19]

Rohrer et al.

[11] Patent Number: 5,063,647

[45] Date of Patent: Nov. 12, 1991

[54] METHOD FOR HANDLING AND FURTHER PROCESSING A HONEYCOMB BAND

[75] Inventors: Christoph Rohrer, Binningen; Hans Schmidlin, Aesch, both of Switzerland

[73] Assignee: Hans Schmidlin, Aesch, Switzerland

[21] Appl. No.: 387,272

[22] Filed: Jul. 31, 1989

[30] Foreign Application Priority Data

Jul. 29, 1988 [DE] Fed. Rep. of Germany ..... 3825861

[51] Int. Cl.[5] ..... B21D 31/04

[52] U.S. Cl. ..... 29/6.1; 156/193; 156/197; 242/156.1; 242/75.42; 242/128; 29/897.32

[58] Field of Search ..... 29/6.1, 897, 897.3, 29/897.32, 33 R, 33 S, 417, 419; 156/184, 185, 187, 193, 197; 242/156.1, 75.41, 75.42, 128, 55; 414/786

[56] References Cited

U.S. PATENT DOCUMENTS 2,829,733 4/1958 Bartels et al. ..... 29/6.1 X
3,257,253 6/1966 Hoyt ..... 156/256
4,921,118 5/1990 Gass ..... 29/6.1 X

FOREIGN PATENT DOCUMENTS 0345489 5/1989 European Pat. Off. ..... 29/6.1
3413409 10/1985 Fed. Rep. of Germany .

*Primary Examiner*—Joseph M. Gorski
*Assistant Examiner*—S. Thomas Hughes
*Attorney, Agent, or Firm*—Foley & Lardner

[57] ABSTRACT

A method and an apparatus for handling further processing a continuously produced, unstretched honeycomb band is disclosed. To facilitate handling and further processing of the unstretched honeycomb band, the following process steps are used:

a) the honeycomb band is reeled and temporarily stored as a reel or marketed as a separate commercial product;
b) for further processing, the unstretched honeycomb band is unwound from the reel and stretched into the desired final shape; and
c) the desired partial lengths are cut off from the continuous, stretched honeycomb band.

16 Claims, 8 Drawing Sheets

Fig. 8
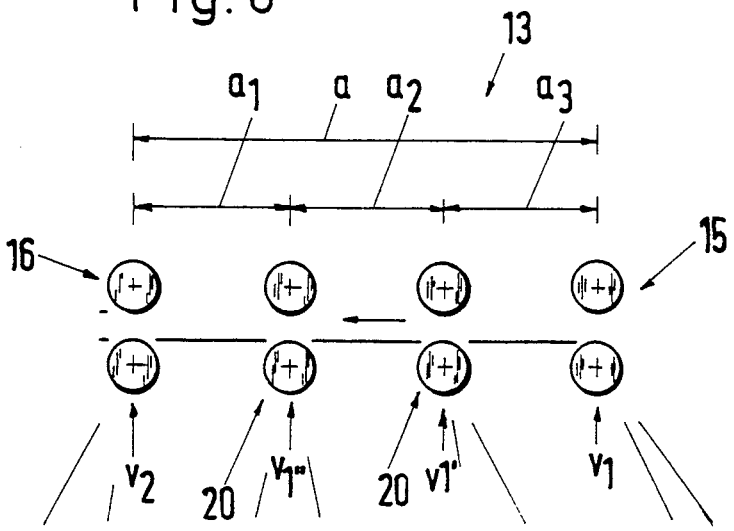
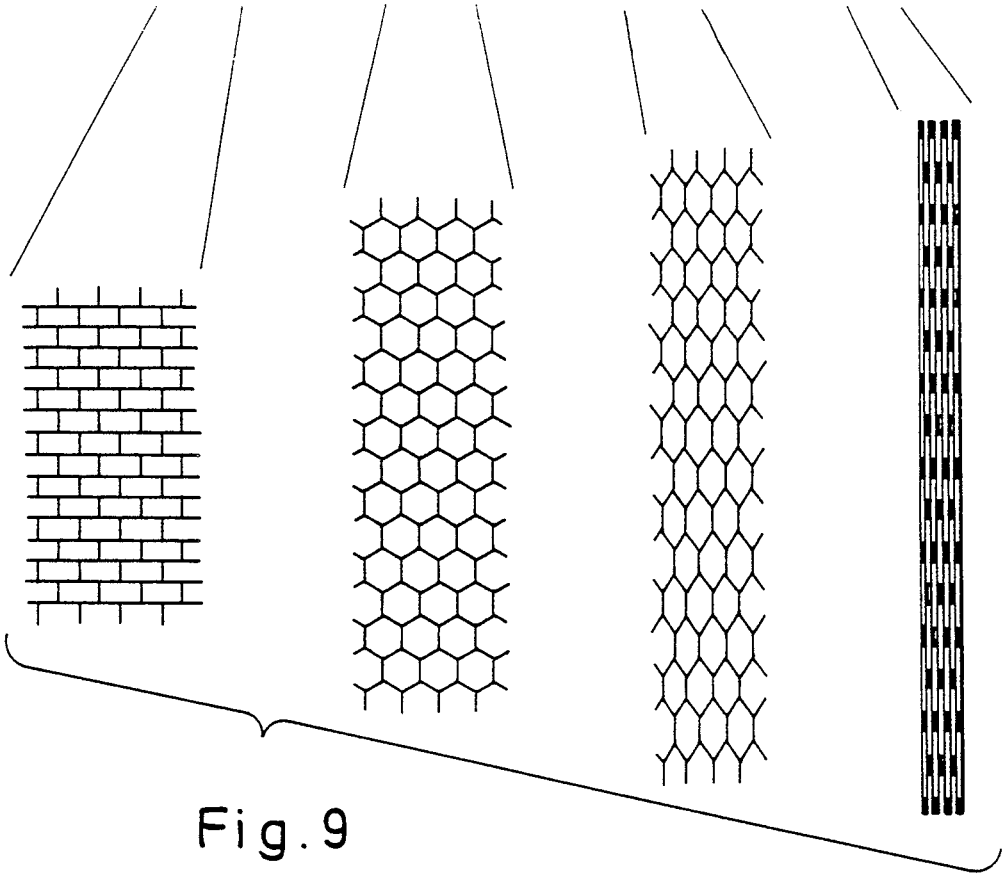
Fig. 9

METHOD FOR HANDLING AND FURTHER PROCESSING A HONEYCOMB BAND

BACKGROUND OF THE INVENTION

The present invention relates to a method for handling and further processing a continuously produced, unstretched honeycomb band and to an apparatus for carrying out this method.

U.S. Pat. No. 3,257,253 discloses production of a continuous, stretched honeycomb band which, during its stretching operation, is continuously laminated on its top and bottom sides with a continuous paper layer.

It is also known for metal and board honeycombs to be delivered and processed unstretched, or alternatively stretched, in the form of blocks. On the basis of the conventional production methods for unstretched honeycombs, this results in sheeting blocks having a thickness of between about 2 cm and 15 cm, from which strips of the desired honeycomb height can be cut as required. Depending on the thickness of the sheeting block and the cell diameter, this produces stretched honeycombs between 1 and 10 m in length. These stretching machines operate in cycles and have to be designed for the maximum honeycomb length. This entails a very large space requirement. The transport and storage volumes for these stretched honeycombs are large; the handling of the stretched honeycombs is relatively expensive. In order to avoid local destruction of the stretched honeycombs as a result of external effects during transport and storage, large-area interlayers have to be incorporated. Stretched honeycombs have a large surface area liable to corrosion or contamination with dust and moisture, which can result in the costly material deteriorating in quality or even becoming valueless as a result of improper storage.

SUMMARY OF THE INVENTION

It is therefore an object of the present invention to provide a method and an apparatus that permit simpler handling of the honeycomb material, its storage and transportation in a manner such as to save space and costs, a reduction of the risk of contamination and corrosion, and processing on compact installations.

These and other objects are achieved, according to the invention, by the following process steps:

a) winding the unstretched honeycomb band onto a reel;

b) unwinding the unstretched honeycomb band from the real and stretching it into a desired final shape;

c) cutting the desired partial lengths from the continuous, stretched honeycomb band.

The objects of the invention are also achieved by an apparatus comprising:

a reel for receiving and discharging an unstretched honeycomb band;

a device to prevent misalignment of the honeycomb layers;

a stretching device for the honeycomb band, comprising a drawing-in apparatus which operates in a largely slip-free manner relative to the honeycomb band, at least one free stretching zone arranged downstream of the drawing-in apparatus, and a drawing-out apparatus arranged downstream of the drawing-in apparatus and the free stretching zone that also operates in a substantially slip-free manner; and a length-cutting apparatus arranged downstream of the stretching device.

Further features of the invention are explained in detail in connection with further advantages of the invention, with reference to exemplary embodiments.

The present invention permits continuous manufacture of the honeycombs. The storage and transport volume for unstretched honeycombs is reduced. The honeycombs can be stretched in a continuous operation. The length of honeycombs can be selected as desired after their stretching. This makes it possible to optimize the waste situation.

BRIEF DESCRIPTION OF THE DRAWING

In the drawing, a number of embodiments of the invention, serving as examples, are illustrated diagrammatically, as follows:

FIG. 8 shows a multi-stage stretching device in an illustration according to FIG. 4;

FIG. 9 shows a plan view of the stretching of a honeycomb band in the individual stages of a stretching device according to FIG. 8;

DETAILED DESCRIPTION OF THE PREFERRED EMBODIMENTS

Figure 1:
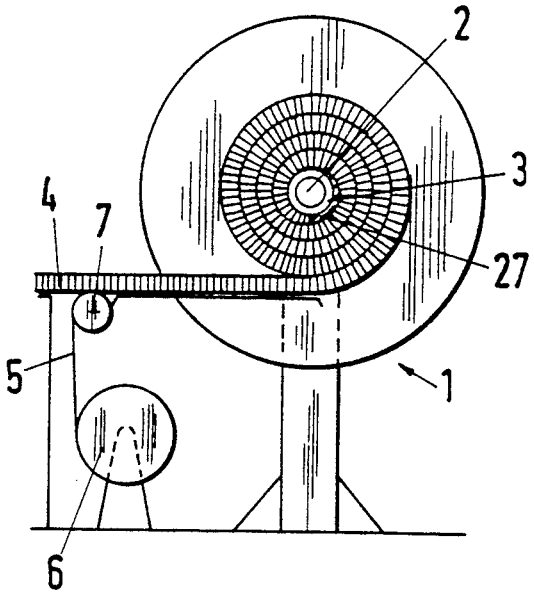
FIG. 1 shows, in a lateral view, a reel with a device to prevent misalignment of the honeycomb layers.

FIG. 1 shows a reel 1 having a reel shaft 2 and a sleeve 3 pushed thereon, on which is wound an unstretched honeycomb band 4. In order to prevent misalignment of the honeycomb layers, a thin belt 5, a band, a film, a paper strip or the like is wound up with the honeycomb band 4 during the winding of the latter and is tightly stretched against the outside of the honeycomb band 4 (against the underside of the honeycomb band 4 in FIG. 1). The belt 5 or the like is unwound from a belt roller 6, which is preferably braked, so that the unstretched honeycomb band 4 can be brought onto the reel 1 in a closely pressed position. When this is done, it is unnecessary to mount the reel 1 in a manner which adapts to the changing reel circumference.

During winding, it is advantageous if the honeycomb band 4 is impelled.

The unstretched honeycomb band 4 can be subsequently processed directly from the reel 1 according to FIG. 1. In this case the unwinding drive can be provided via the belt 5, which is guided over a deflection roller 7 and is wound onto the belt roller 6 at a slightly greater speed as compared with the speed at which the honeycomb band 4 is pulled into a stretching device to be explained below. The drawing-in apparatus of the stretching device, to be explained in detail below, exerts a braking effect on the belt roller 6, so that the belt 5 or the like remains tightly stretched and the honeycomb band 4 bears on the entire circumference of the reel 1 and prevents a misalignment. If the reel 1 has run empty, either the belt or the like can be rolled up again on the reel 1 (reusable belt fixedly connected to the reel 1), or alternatively the belt 5 or the like is removed from the empty reel 1 and replaced with a new belt from the belt roller 6 for reloading.

Figure 2:
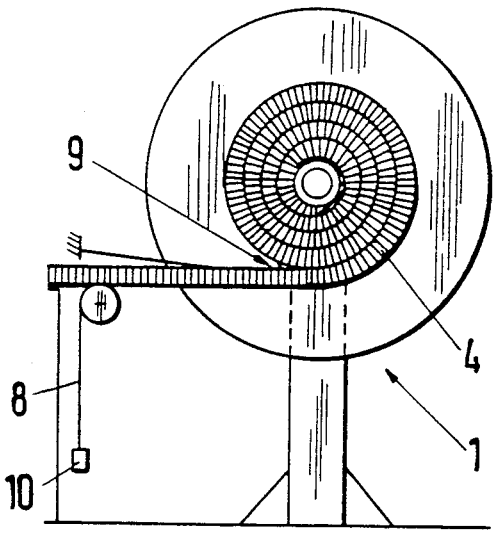
FIG. 2 shows a modified embodiment in an illustration according to FIG. 1.

In the embodiment according to FIG. 2, the device for preventing the misalignment of the honeycomb layers comprises a stationarily arranged sheet metal band or belt band 8 which is guided around a deflection 9, encompasses the pre-reeled honeycomb band 4 and is kept constantly tight by a weight 10. The current outer surface of the wound honeycomb band 4 slides along this stationary support, a driven reel mounting being advantageous in order to wind an impelled honeycomb band 4 and to unwind it. Furthermore, it is expedient to design the reel mounting to be vertically adjustable.

Figure 3:
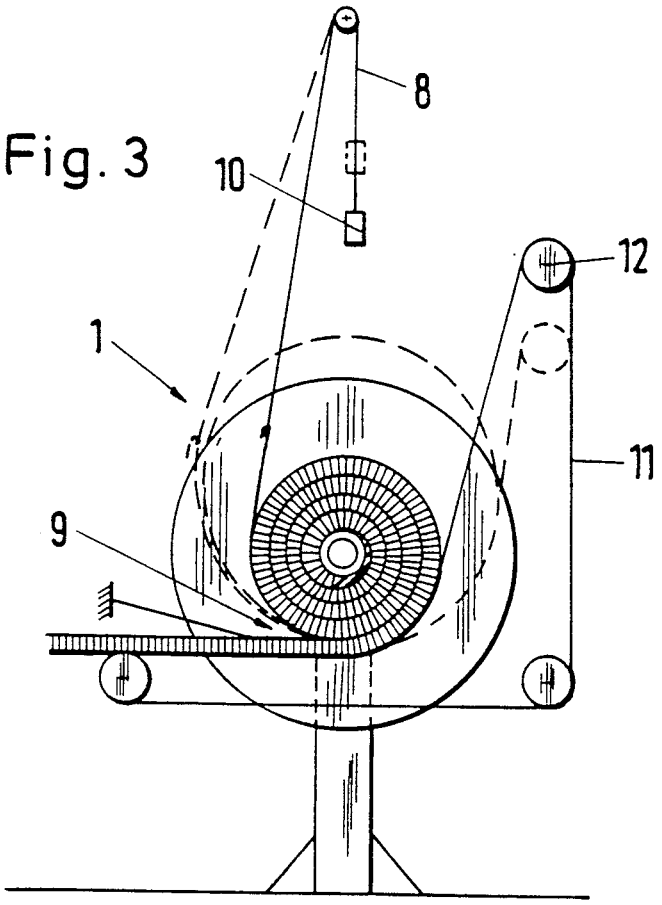
FIG. 3 shows a modified embodiment in an illustration according to FIG. 1.

The embodiment of a reel shown in FIG. 3 likewise possesses a device to prevent the misalignment of the honeycomb layers. This device conforms to the solution according to FIG. 2 in comprising a sheet metal band or belt band 8 loaded by a weight 10, but exhibits a reduced angle of belt wrap as compared to the wound-up honeycomb band 4. A further loop is provided here by a supporting conveyor belt 11 whose upper deflection roller 12 is adjustably mounted (see illustration in broken lines), so that the supporting conveyor belt 11 can be adapted to the increasing or decreasing circumference of the wound-up honeycomb band 4 in the same way as the sheet metal band or belt band 8. The supporting conveyor belt 11 can simultaneously form the drive for the winding or unwinding process.

Figure 7:
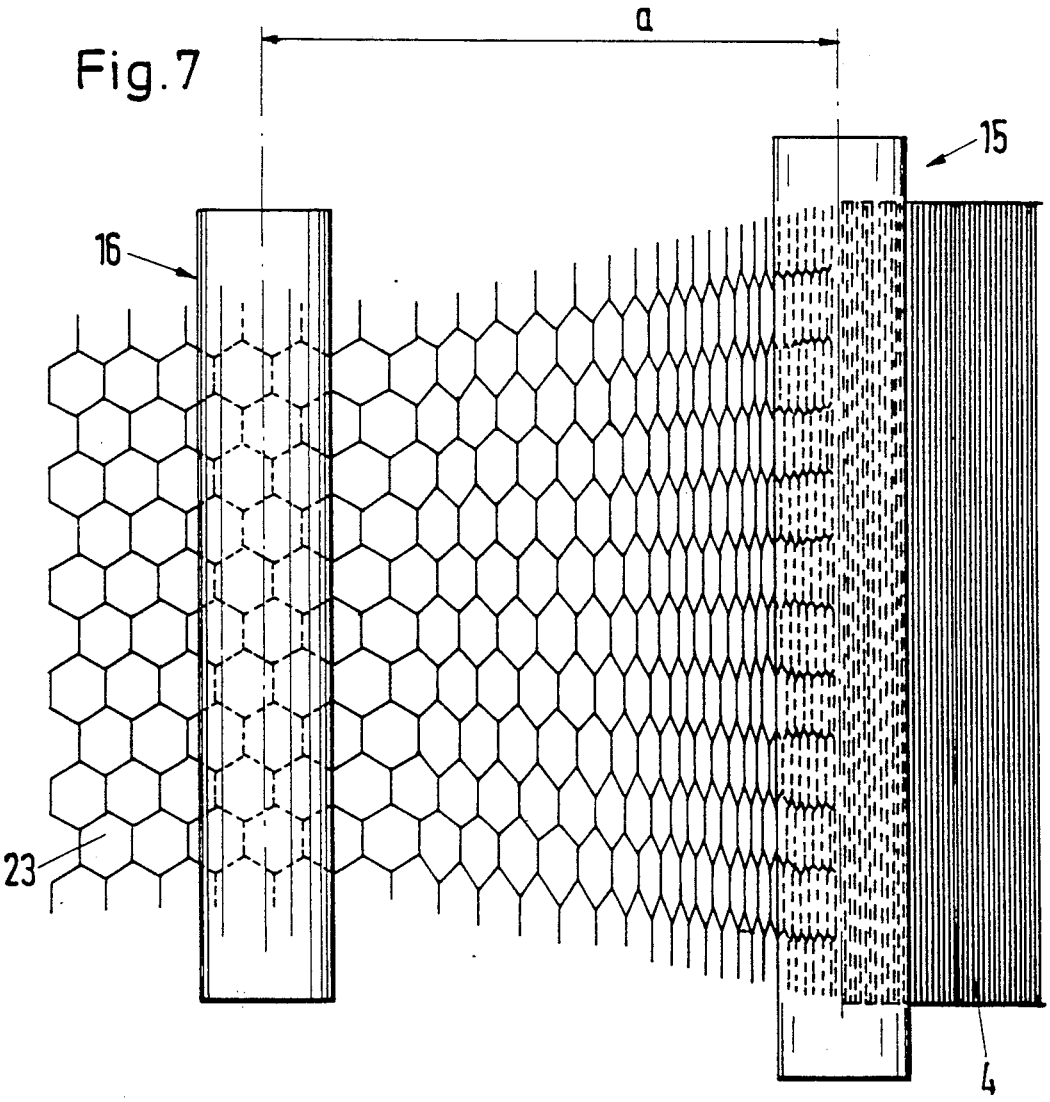
FIG. 7 is a plan view of the illustration according to FIG. 6.

FIG. 4 shows four alternative solutions for a stretching device 13 installed downstream of the reel 1, in which stretching device the unstretched honeycomb band 4 unwound from the reel 1 is stretched in its lengthwise direction (arrow 14) into the desired honeycomb structure (see FIGS. 7 and 9). Each of the alternative solutions shown in FIGS. 4 and 5 possesses a drawing-in apparatus 15, a free stretching zone a installed downstream of the latter, and a drawing-out apparatus 16 installed downstream of the latter.

In the alternative solutions according to FIG. 4, the drawing-in apparatus 15 and/or drawing-out apparatus 16 are each composed of a pair of rollers or conveyor belts, the drawing-in apparatus 15 operating at the drawing-in speed v1 and the drawing-out apparatus 16 at the drawing-out speed v2, v1 being less than v2.

Figure 4A:
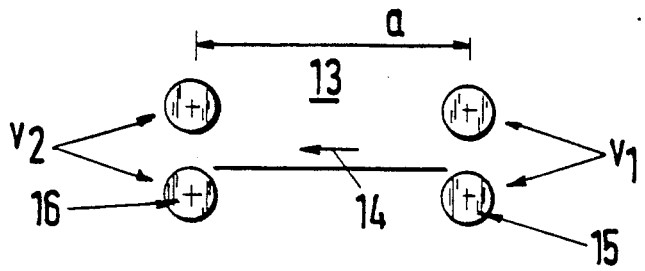
FIGS. 4*a*–4*d* show four different embodiments for a stretching device composed of pairs of rollers or conveyor belts, each in a lateral view.
Figure 4B:
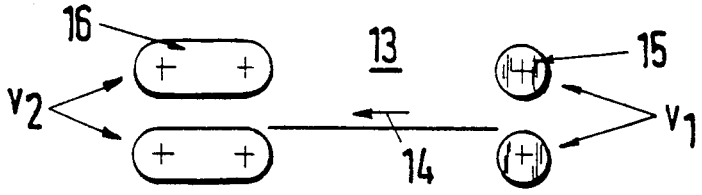
Figure 4C:
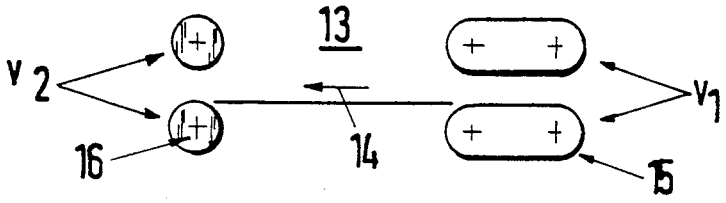
Figure 4D:
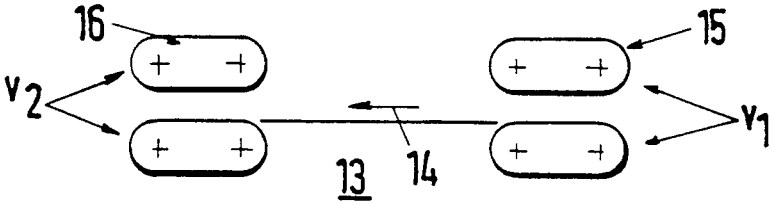
Figure 5A:
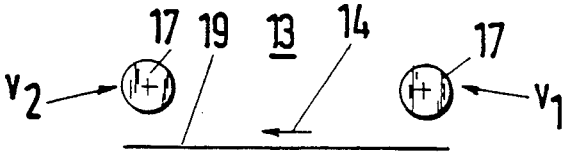
FIGS. 5*a*–5*d* show a modified embodiment in an illustration according to FIG. 4.
Figure 5B:
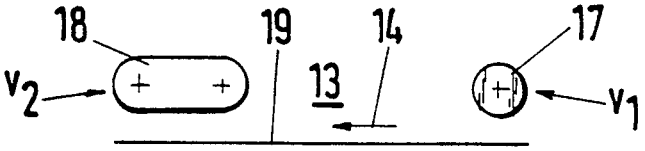
Figure 5C:
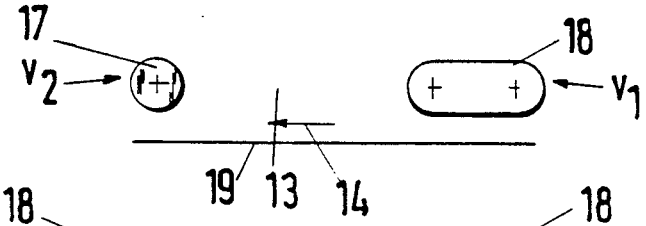
Figure 5D:
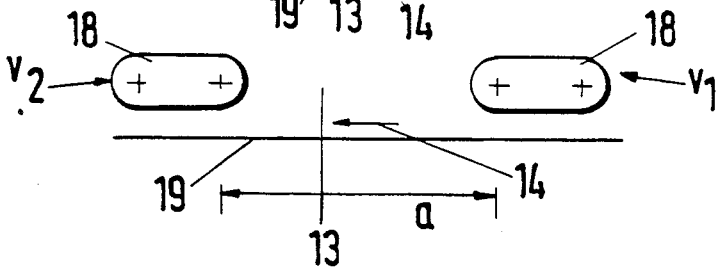

FIGS. 3 and 4 clearly show the mode of operation of the stretching device, 13 according to FIG. 4*a*. The unstretched honeycomb band 4 is conveyed by the counter-rotating rollers of the drawing-in apparatus 15 into a stretching zone a, whence the honeycomb band is drawn down in an accelerated manner by the rollers of the drawing-out apparatus 16, which are counter-rotating at a higher rate of revolution. This results, firstly, in a stretching of the honeycomb band in its conveying direction, the stretching result shown in FIG. 7 revealing a normal, symmetrical honeycomb structure. Simultaneously with the lengthwise stretching, the width of the unstretched honeycomb band 4 diminishes (by about 30% in the exemplary embodiment shown in FIG. 7). This change in width has to be made possible during the stretching process without transverse tension, in order to avoid stresses on the local bonds and on the thin foil strips of the honeycomb band. Depending on the diameter and geometry of the cells, and the desired result of stretching the honeycomb structure, the ratio of v2 to v1 can be selected higher or lower, this speed ratio corresponding to the ratio between the diameter of the stretched honeycomb cell and the diameter of the unstretched honeycomb cell. Stresses on the material are avoided if the rollers or conveyor belts of the drawing-in apparatus 15 and drawing-out apparatus 16 work without slipping, that is to say permit no speed differentials between the peripheral speed and the honeycomb tape. The result of this is to reduce the danger of destroying the honeycomb structure (especially in the case of very thin and soft materials of construction); wear on the roller or belt surfaces, and their contamination with abrasion residues are reduced. This is important in the case of honeycomb bands composed of aluminum foil, since aluminum tends to smear under the action of friction.

The surfaces of the drawing-in and drawing-out apparatuses 15,16 can, for example, advantageously be rubberized.

FIG. 5 shows four alternative solutions to the stretching device 13 which are more economical as compared with those in FIG. 4, but cannot be monitored so precisely in automatic operation and, depending on the geometry and material of the honeycomb material, may damage this or distort it in an undesired manner. In these alternative solutions, the drawing-in apparatuses 15 and drawing-out apparatuses 16 are each composed only of a single roller 17 and of a single conveyor belt 18 respectively, and of a sliding metal sheet 19 assigned thereto and supporting the honeycomb band.

In order to process different honeycomb heights or honeycomb band thicknesses, it is advantageous if the height of the gap in the drawing-in or the drawing-out region is adjustable.

The stretching device 13 shown in FIG. 8 is of multistage design, the stretching zone a being sub-divided into partial regions a3, a2 and a1 by additional pairs of rollers (which could also be replaced by pairs of conveyor belts) with correspondingly adaptable speeds. The result of this is the achievement of increased controllability of the result of stretching, the possibility of producing over-stretched honeycomb structures, to save materials, and adapting the speed ratios to the required stretching geometry, of which three examples are shown in FIG. 9. However, normally stretched honeycomb structures can also be produced on such a multi-staged stretching device, with increased precision in respect of cell diameter and cell geometry. Furthermore, such an installation is suitable for the stretching of honeycomb bands which are produced from relatively thick and rigid materials, since the forces necessary for deformation (expansion) are applied gradually by tension, which has to be transmitted by the local adhesion points.

Figure 10:
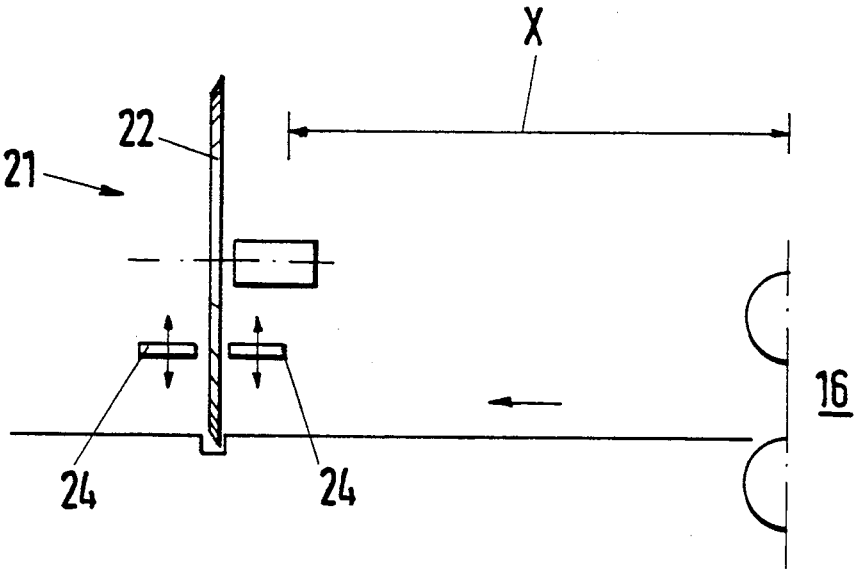
FIG. 10 shows a length-cutting apparatus in a lateral view.

FIG. 10 shows a length-cutting apparatus 21 installed downstream of the stretching device 13 and possessing, on each side of a cutting element 22, a hold-down strip 24 which extends over the entire honeycomb width and can be lowered onto the stretched honeycomb band 23. The cutting element 22 may be formed by a rotating knife disk or alternatively by a sharp knife blade, the separating cut with a blade possibly being advantageous because of the avoidance in this case of swarf formation and the associated contamination. The hold-down strips 24 prevent a change in the honeycomb structure during the separating cut, which runs transversely to the direction of stretching. After the hold-down strips 24 are released, the cut-to-length honeycomb structure is ejected by the stretched honeycomb band 23 which follows it from the stretching device 13.

The length-cutting apparatus 21 permits optimum utilization of the costly honeycomb material, and enables the user to optimize the waste situation in preparing the honeycombs.

In order to achieve a continuous process for processing the stretched honeycomb band 23, a buffer stretch X is provided between the drawing-out apparatus 16 of the stretching device 13 and the stationary length-cutting apparatus 21, within which buffer stretch the stretched honeycomb band 23 is compressed, within its range of elastic deformation, during the length-cutting process. If the structural length of the installation is to be shortened by omitting the buffer stretch X, the installation would have to be operated intermittently.

Figure 11:
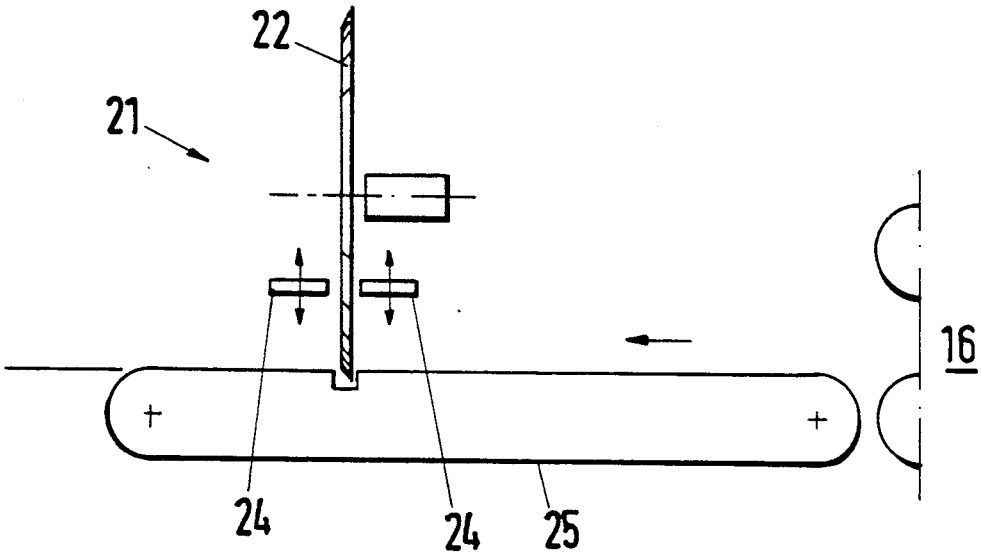
FIG. 11 shows a modified embodiment in an illustration according to FIG. 10.

The length-cutting apparatus 21 shown in FIG. 11 is designed to move with the stretched honeycomb tape, for which purpose a reciprocally running belt 25 is provided.

In the production of sandwich elements with a honeycomb interlayer, it may be necessary to produce elements with a width or length which is greater than that of the starting honeycomb material. In the assembly of the honeycomb sections, it should be noted that the honeycomb structure, because of its composition, possesses different strength properties in its direction of stretching and transversely thereto, which can also be found in the finished sandwich element. It may therefore optionally be arranged that the subsequent element width, or alternatively the subsequent element length should be defined by the first length-cutting apparatus 21 installed downstream of the stretching device 13, so that the subsequent element length or element width, respectively, can then be determined by a second length-cutting apparatus.

Figure 6:
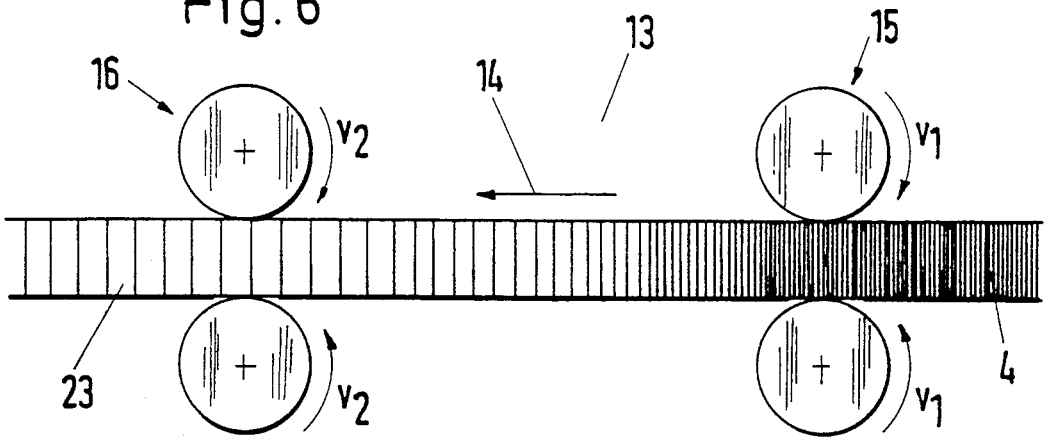
FIG. 6 shows a stretching device according to FIG. a) on an enlarged scale.
Figure 12:
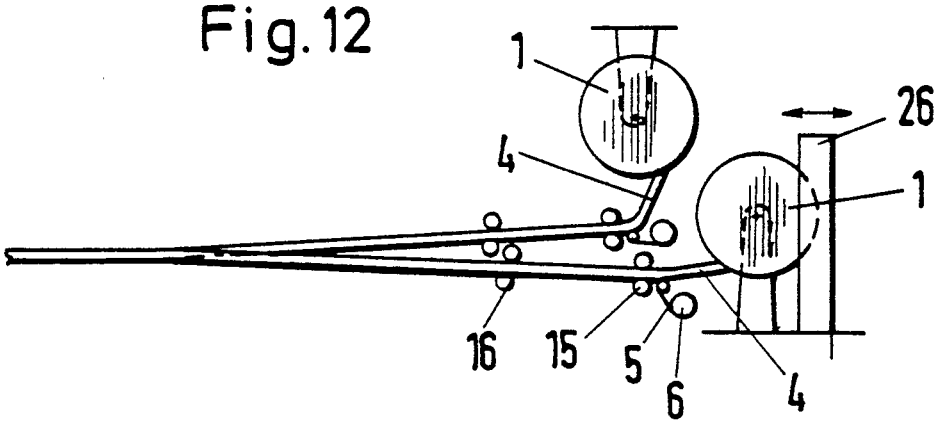
FIG. 12 shows a lateral view of a processing installation operation in two reels.
Figure 13:
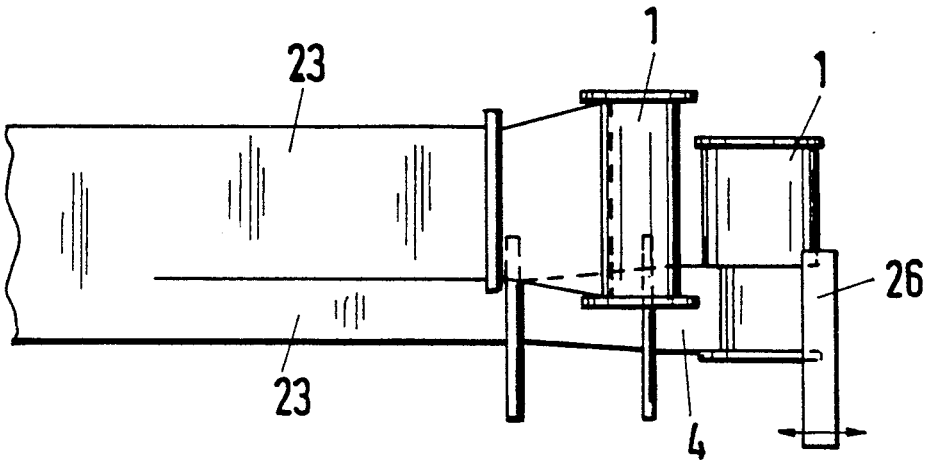
FIG. 13 shows the installation according to FIG. 12 in a plan view.

FIGS. 12 and 13 show a possible method for working with two reels 1. This arrangement makes it possible to load a panel installation operating by the continuous method. FIG. 13 shows that only part of the width of the unstretched honeycomb band 4 is processed by the lower reel 1, which is made possible by a cutting device 26. As a result, it is possible to produce panels which are overwidth from the standpoint of the honeycomb base material, which enables wastage of the expensive honeycomb material as a result of cutting to be minimized. In addition, the installation shown comprises two reels 1 carrying an unwinding device according to FIG. 1 formed by belt roller 6 and belt 5, two simple stretching devices 13 according to FIG. 6, and a device, not shown in more detail, for bringing together the two stretched honeycomb bands 23 in order to form an overwidth in comparison to the original width of the unstretched honeycomb band 4. The cutting device 26 for the lengthwise separation of the unstretched honeycomb band 4 on the reel 1 can be designed as a movable band saw. The additional width cut off is unwound, while the residual width remains on the reel.

Figure 14:
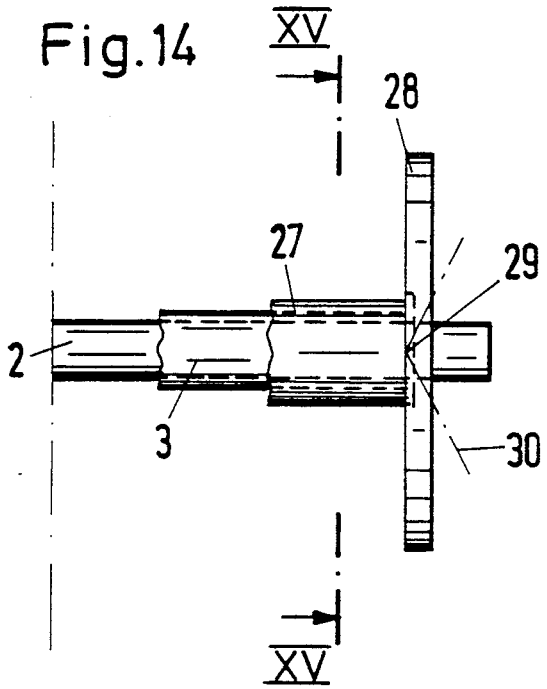
FIG. 14 shows the right-hand half of a reel in a lateral view.

The reel according to FIG. 14 is composed of a shaft 2, a reel core sleeve 3 pushed onto the latter, an outer shell 27 (preferably spiral in cross-section) pushed onto the latter, and two end disks 28 pushed laterally onto the shaft 2 and having an external diameter greater than the external diameter of the complete reel product (not shown in FIG. 14). Each end disk 28 is connected for rotation to the reel core sleeve 3 by means of at least one axially aligned dog 29. This dog 29 can be located on the end disk 28 and be designed in the form of inward-pointing, preferably sharp-edged projections (teeth, prongs, grooving or the like), which dig into the end face of the reel core sleeve 3 and thus produce the above-mentioned connection for the purposes of rotation.

The end disks 28 are pushed laterally onto the shaft 2 and locked in the desired position by means of clamping screws 30, adaptor sleeves or the like. The end disks 28, composed of wood, sheet metal, plastic or the like, serve, inter alia, to laterally guide the honeycomb band (see FIG. 16) during winding, to protect the wound honeycomb band 4, and to provide a bearing surface for transporting and handling the reel 1.

The shaft 2 can be designed as a clocking-lever shaft, tube or the like.

The reel core sleeve 3 is composed of economical, strong but easily divisible material, and is for example formed from a wound tube of kraft paper, similarly to a reel draw for carpet, paper or fabric.

Figure 15:
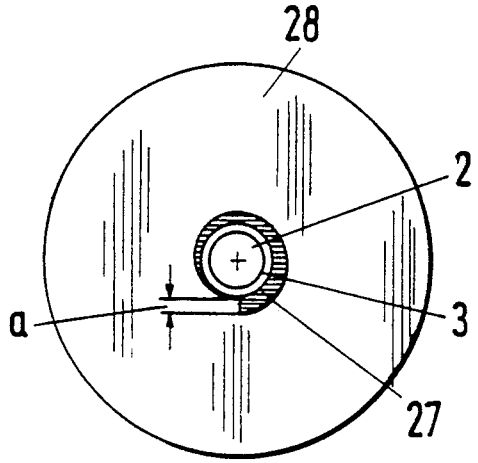
FIG. 15 shows a cross-section along the line XV—XV in FIG. 14.

The outer shell 27 possesses, according to FIG. 15, a diametral offset a, having a radial height corresponding to the honeycomb height of the honeycomb band 4 to be wound. This outer shell 27 can be capable of being pushed or slid onto the reel core sleeve 3, so that the same standard core sleeve can be used for all cases of application, only the outer shell 27 which is to be slid on needing to be adapted to the thickness or height of the honeycombs to be processed. In this case, the outer shell 27 may also be composed of partial components slid onto the reel core sleeve 3. The outer shell 27 can, however, also be fixedly connected to the reel core sleeve 3, so that reel core sleeves 3 have to be used which are adapted in accordance with different honeycomb thicknesses or heights. In this case the reel core sleeve 3 can be manufactured directly with a corresponding outer shell 27, or alternatively the outer shell 27 can be cast, foamed or otherwise molded onto the reel core sleeve 3. The outer shell 27 could also be composed of flexible material of wedge-shaped cross-section, for example rubber, which is fixed to the circumference of the reel core sleeve 3 by bonding, clipping, shrink-fitting or the like.

Figure 16:
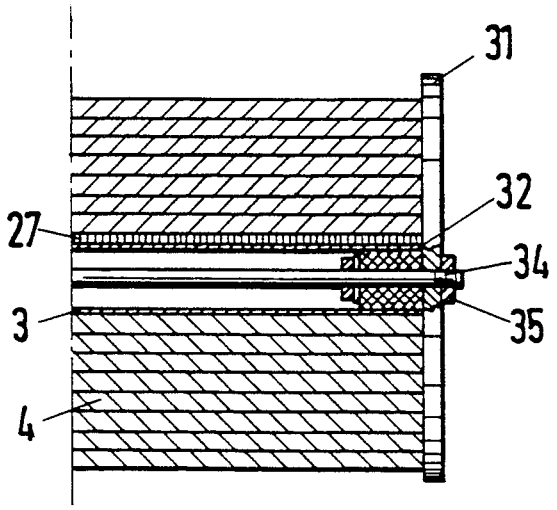
FIG. 16 shows a lengthwise section through the right-hand half of a reel in a modified embodiment with product wound on the reel.

In every case the outer shell 27 is composed, in the same way as the reel core sleeve 3, of easily divisible material. As a result, the possibility exists, when unwinding the honeycomb band 4 from the reel, of subdividing the honeycomb band into two widths by lengthwise cutting and, at the same time, also cutting through the outer shell 27 together with the reel core sleeve 3 for the purposes of temporary storage of the residual width of the honeycomb band separated off by this separating cut without rewinding on an appropriately narrower reel. In this case, it is advantageous if the costly reel according to FIGS. 14 and 15 for the storage and/or the transport and for the further processing of the unstretched honeycomb band 4 from the reel 1 is designed as follows:

After the unstretched honeycomb band 4 has been wound and secured, the end disks 28 are pulled off, and the relatively costly shaft 2 is withdrawn from the reel core sleeve 3. Instead of this, storage and transport end disks 31 are used which, according to FIG. 16, are each pushed into the reel core sleeve 3 by means of an axially inward-pointing centering pin 32, whose external diameter corresponds to that of the shaft 2. In this case, as can be seen from FIG. 20, this centering pin 32 can also be designed as a bearing 33. These two pushed-on storage and transport end disks 31 are secured by means of a threaded rod 34 pushed centrally through the reel core sleeve 3 and by clamping nuts 35 screwed onto the latter. In the case of the storage and transport end disks 31, again, the external diameter is greater than that of the complete reeled product, as shown in FIG. 16.

Figure 17:
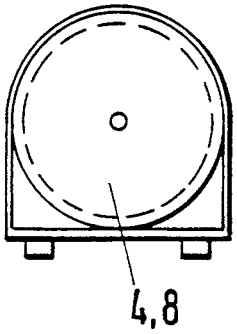
FIG. 17 shows an end view of a packed reel on a smaller scale.
Figure 18:
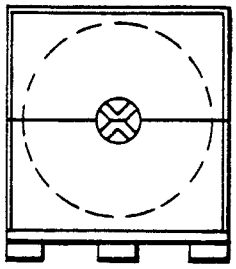
FIG. 18 shows a modified embodiment in an illustration according to FIG. 17.
Figure 19:
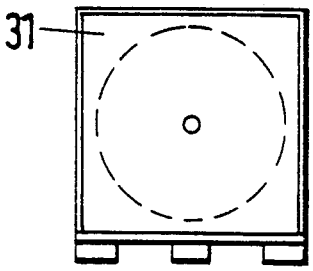
FIG. 19 shows a modified embodiment in an illustration according to FIGS. 17 and 18.

FIGS. 17 to 19 show three possible packaging alternatives. The reel according to FIG. 17 is provided with circular end disks 28, 31, whereas in the alternative according to FIG. 18 the reel is packaged without end disks. In the design according to FIGS. 19 and 21, square storage and transport end disks 31 are provided. With this square design, in particular, the storage and transport end disks 31 can also form a part of the transport packaging. This provides the further possibility of stacking the reels without further accessories, such as frames, brackets or the like, and thus achieving a further saving of space and cost during storage. In this arrangement, at least one edge section 36 of the storage and transport end disk 31 can possess a channel 37 which is open to the outside, and at least one further edge section 38 can possess a cross-sectional contour corresponding to the channel 37 (see lower illustration in FIG. 20). This enables various reels to be stacked one above the other with a close mutual fit of the superposed edge sections 36, 38. Instead of a corresponding design of the edge sections 36, 38, an interlayer 39 in the form of a double-T profile can also be used in each case (see upper illustration in FIG. 20).

Figure 20:
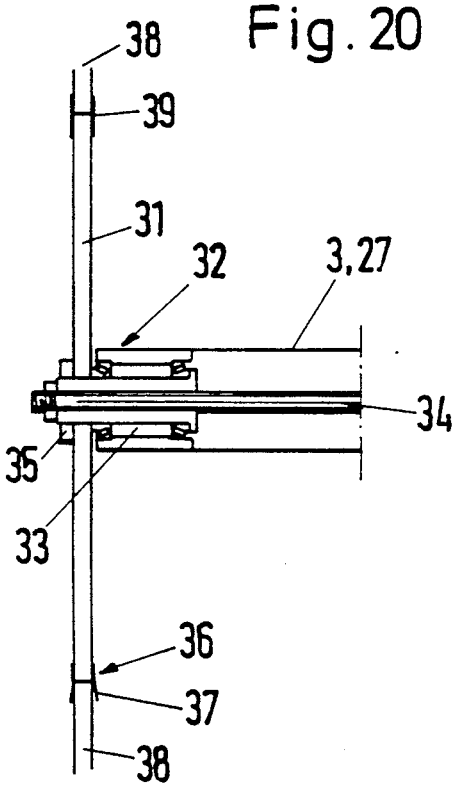
FIG. 20 shows a lengthwise section through the left-hand section of a reel in a modified embodiment.
Figure 21:
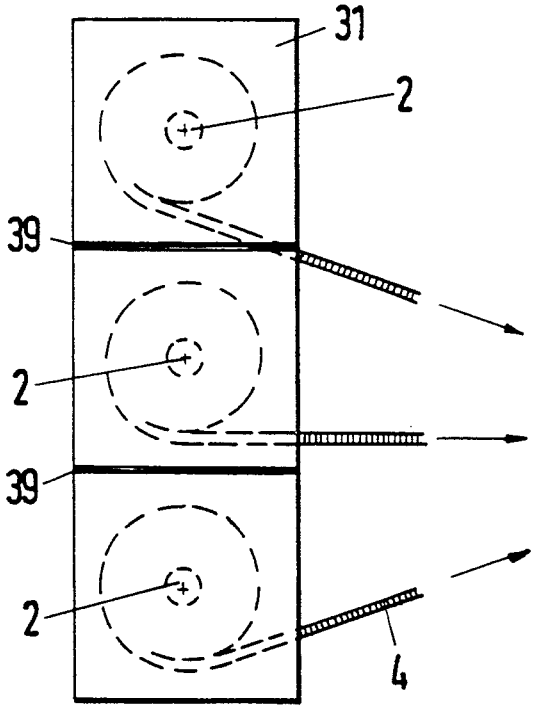
FIG. 21 shows stacked reels in an illustration according to FIGS. 17 to 19.

In the arrangement shown in FIG. 21, it is possible to process further the required honeycomb band 4 from either reel, as required. This solution saves the end user additional conversion times, which is very advantageous in cost terms, particularly in the production of small orders. In the solution according to FIG. 21, bearings 33 according to FIG. 20 are used for the storage and transport end disks 31.

Figure 22:
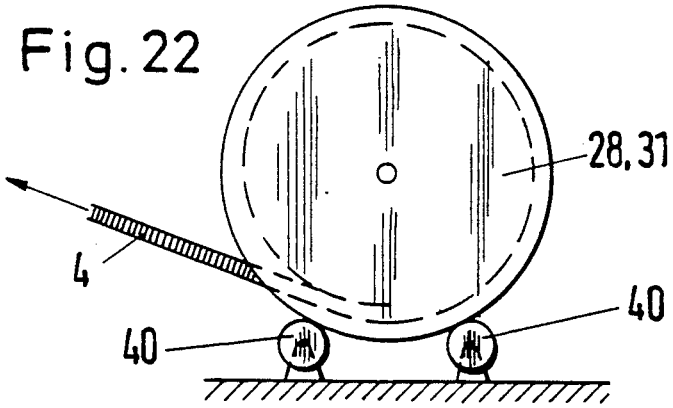
FIG. 22 shows a modified embodiment in an illustration according to FIG. 21.

In the embodiment according to FIG. 22, circular storage and transport end disks 31 are used, which make it possible, when the honeycomb band 4 is being unwound for its further processing, to provide, instead of a central reel bearing, for the outer circumference of the end disks 28 or storage and transport end disks 31 to roll on two shafts or pairs of bearings 40. This again results in economical handling and economical conversion times.

With a central bearing of the reel, the honeycomb band 4 can be unwound with or without end disks 28, 31.

In a modified embodiment, the possibility also exists of subdividing the reel shaft 2 into at least two partial lengths, in order to create the possibility, when unwinding the honeycomb band 4 from the reel 1, of subdividing the honeycomb band into two widths by lengthwise cutting, the lengthwise cut being aligned with the separation between the two partial lengths of the reel shaft 2. The residual width of the honeycomb band 4 separated by this lengthwise cut can then be temporarily stored on a correspondingly narrower reel without rewinding.

Since the unstretched honeycomb band 4 can be subdivided into two widths by lengthwise cutting in the reel 1, the possibility exists of optionally unwinding and processing only one partial width or alternatively both partial widths.

What is claimed is:

1. A method of handling and further processing a continuously produced, unstretched honeycomb band, comprising the following process steps:
   (a) winding an unstretched honeycomb band onto a reel;
   (b) unwinding the unstretched honeycomb band from the reel and stretching it into a desired final shape thereby producing a continuous, stretched honeycomb band; and
   (c) cutting desired partial lengths from the continuous, stretched honeycomb band.

2. The method as claimed in claim 1, wherein said winding step comprises continuously advancing the honeycomb band.

3. The method as claimed in claim 1, wherein said winding step comprises supporting at least one section of a current exterior periphery of the unstretched honeycomb band on the reel.

4. The method as claimed in claim 3, wherein said winding step comprises winding thin belts together with the unstretched band.

5. The method as claimed in claim 4, wherein said winding step comprises braking of the reel by the belts and said unwinding step comprises driving of the reel by the belts.

6. The method as claimed in claim 1, wherein said winding step comprises varying a height of the reel in response to increasing diameter.

7. The method as claimed in claim 1, wherein said unwinding step comprises continuously conveying the honeycomb band into a stretching zone at a speed v1 and out of this stretching zone at a speed v2, where $v1 < v2$, and stretching the honeycomb band within the stretching zone in a manner substantially free of transverse tension.

8. The method as claimed in claim 1, wherein said unwinding step comprises subdividing the unstretched honeycomb band into two widths by lengthwise cutting.

9. The method as claimed in claim 8, additionally comprising the step of assembling subwidths of stretched honeycomb bands into an overwidth.

10. A method as claimed in claim 1, wherein said unwinding step comprises stretching the unstretched honeycomb band into a rectangular shape.

11. A method of handling and further processing a continuously produced, unstretched honeycomb band, consisting essentially of the following process steps:

(a) winding an unstretched honeycomb band onto a reel;

(b) unwinding the unstretched honeycomb band from the reel and stretching it into a desired final shape thereby producing a continuous, stretched honeycomb band; and (c) cutting desired partial lengths from the continuous, stretched honeycomb band.

12. A method as claimed in claim 11, wherein said unwinding step comprises stretching the unstretched honeycomb band into a rectangular shape.

13. A method of handling and further processing a continuously produced, unstretched honeycomb band, comprising the following process steps:

(a) winding an unstretched honeycomb band onto a reel, said winding step comprising supporting at least one section of a current exterior periphery of the unstretched honeycomb band on the reel and winding thin belts together with the unstretched band;

(b) unwinding the unstretched honeycomb band from the reel and stretching it into a desired final shape, thereby producing a continuous, stretched honeycomb band; and (c) cutting desired partial lengths from the continuous, stretched honeycomb band.

14. The method as claimed in claim 13, wherein said winding step comprises braking of the reel by the belts and said unwinding step comprises driving of the reel by the belts.

15. A method of handling and further processing a continuously produced, unstretched honeycomb band, comprising the following process steps:

(a) winding an unstretched honeycomb band onto a reel, said winding step comprising supporting at least one section of a current exterior periphery of the unstretched honeycomb band on the reel and winding thin belts together with the unstretched band;

(b) unwinding the unstretched honeycomb band from the reel and stretching it into a desired final shape, thereby producing a continuous, stretched honeycomb band, said unwinding step comprising continuously conveying the honeycomb band into a stretching zone at a speed $v1$ and out of this stretching zone at a speed $v2$, where $v1 < v2$, and stretching the honeycomb within the stretching zone in a manner substantially free of transverse tension; and (c) cutting desired partial lengths from the continuous, stretched honeycomb band.

16. A method of handling and further processing a continuously produced, unstretched honeycomb band, consisting essentially of the following process steps:

(a) winding an unstretched honeycomb band onto a reel;

(b) unwinding the unstretched honeycomb band from the reel and stretching it into a desired final shape, thereby producing a continuous, stretched honeycomb band, said unwinding step comprises subdividing the unstretched honeycomb band into two widths by lengthwise cutting and additionally comprising the step of assembling the subwidths of stretched honeycomb bands into an overwidth; and (c) cutting desired partial lengths from the continuous, stretched honeycomb band.

* * * * *